US007854977B2

(12) United States Patent
Kajiwara

(10) Patent No.: US 7,854,977 B2
(45) Date of Patent: Dec. 21, 2010

(54) FOAMING TOOL

(76) Inventor: Junko Kajiwara, 3-25-303, Takatori 1-chome, Sawara-ku, Fukuoka-shi (JP) 814-0011

( * ) Notice: Subject to any disclaimer, the term of this patent is extended or adjusted under 35 U.S.C. 154(b) by 6 days.

(21) Appl. No.: 11/658,165

(22) PCT Filed: Jul. 19, 2005

(86) PCT No.: PCT/JP2005/013265

§ 371 (c)(1),
(2), (4) Date: Mar. 19, 2007

(87) PCT Pub. No.: WO2006/009151

PCT Pub. Date: Jan. 26, 2006

(65) Prior Publication Data

US 2008/0069999 A1 Mar. 20, 2008

(30) Foreign Application Priority Data

Jul. 20, 2004 (JP) ..... 2004-212105

(51) Int. Cl.
*B60R 21/16* (2006.01)

(52) U.S. Cl. ..... 428/36.1; 428/35.2; 442/32; 442/49; 442/181; 442/239; 401/201; 15/209.1; 134/6; 134/9

(58) Field of Classification Search ..... 428/35.7, 428/36.1, 36.2, 113, 35.2; 442/32, 49, 181, 442/239; 401/201; 15/209.1; 134/6, 9
See application file for complete search history.

(56) References Cited

FOREIGN PATENT DOCUMENTS

| | | |
|---|---|---|
| JP | 10-276928 | 10/1998 |
| JP | 2001-095716 | 4/2001 |
| JP | 2004-000303 | 1/2004 |

*Primary Examiner*—Michael C Miggins
(74) *Attorney, Agent, or Firm*—Jordan and Hamburg LLP

(57) ABSTRACT

The present invention aims at providing a foaming tool capable of highly efficiently producing creamy foam containing ultra fine bubbles in high proportion. The foaming tool includes a double-layered cloth body composed of vertically overlapped cloth bodies obtained by plain weaving synthetic-resin-fiber warp and wept yarns so as to cause them to alternately position up and down with weave textures of ≦300 μm length and width. The double-layered cloth body has an air layer interposed between the vertically overlapped cloth bodies. The double-layered cloth body is folded once at an appropriate center in the longitudinal direction thereof and thus joined edge portions are assembled and are stitched together to thereby provide a tab portion of gather. In such a constitution, below the tab portion, a foaming auxiliary portion produced by assembling of a cloth body having the same quality as that of the cloth described above is provided.

5 Claims, 13 Drawing Sheets

(a)

(b)

FOAMING TOOL

BACKGROUND OF THE INVENTION

The present invention relates to a foaming tool which can form extremely fine bubbles from detergent such as facial washing cream, solid soap, liquid soap or powder soap, wherein the produced foam can be used for body washing including face washing or for surface washing of various articles.

Conventionally, as this type of foaming tool, there has been known an integrally-molded plastic net having meshes of approximately several mm (for example, see patent literature 1).

However, the integrally-molded plastic net has a planar surface, the meshes are large and, further, when the plastic net is crumpled with a hand in use, shapes of the meshes are transformed and hence, it is difficult to produce foam having a uniform particle size and, further, water is hard to drain and hence, the plastic net has a large quantity of water thus deteriorating foam quality.

That is, according to a result of measurement, most of foam which are produced using a net having meshes of approximately 1 mm has a large particle size of bubbles of 100 μm. Further, a large quantity of water is contained in the foam and hence, when the foam is applied to the face, the foam exhibits poor stretching property, disappears easily and lacks smoothness. Further, since the particle size of bubbles of the produced foam is large, the foam can not enter pores or fine indentations of the skin and hence, a user cannot expect extremely fine washing. Further, although an operation such as crumpling the net with palms becomes necessary for producing foam, when the integrally-molded plastic net having a mesh of approximately several millimeters is used, such an operation stimulates the skin. Accordingly, when the user has atopic dermatitis or the like, there exists a possibility that the palms are hurt and the symptom is worsened.

Accordingly, the applicant has proposed a foaming tool formed of a cloth body which is obtained by plain-weaving warp yarns and weft yarns made of synthetic resin fibers such that the warp yarns and the weft yarns are alternately positioned up and down with weave textures having a length and a width of 300 μm or less.

In producing the foaming tool, the cloth bodies are vertically overlapped to each other to form the double-layer structure and an air layer is formed between both layers, the cloth bodies having the double-layer structure are folded at an approximate center in the longitudinal direction of the cloth bodies, and mating end portions of the cloth bodies are stitched together and, at the same time, gather portion are formed. Accordingly, such a foaming tool can be easily handled and can produce extremely fine, creamy, easy-to-stretch, and hard-to-disappear foam. Further, the cloth bodies are extremely soft and hence, there is no possibility that the cloth bodies give stimulus to the hand which crumples the net (for example, see patent literature 2).

Patent literature 1: JP-A-10-276928

Patent literature 2: JP-A-2004-000303

However, the above-mentioned foaming tool which is formed of plain-woven cloth bodies has a following drawback.

That is, although the foaming tool can certainly produce extremely fine foam easily, the foaming tool can become a more ideal foaming tool when the time necessary for producing foam can be further shortened.

However, even when the shape of the foaming tool is changed to efficiently produce foam, or even when some kind of foaming auxiliary portion is provided to the foaming tool, the foaming tool contrarily reduces a commercial value when the foaming tool gives too much stimulus to the hand or damages the aesthetic appearance in design.

With the aim of providing a foaming tool which can overcome the above-mentioned problems, the applicant repeated various experiments and, as the result, has arrived at the present invention.

SUMMARY OF THE INVENTION

The present invention according to a first aspect thereof provides a foaming tool for detergent in which a two-layered cloth body which is formed by vertically overlapping cloth fibers having weave textures with a length and a width of 300 mm or less and being formed by plain-weaving warp yarns and weft yarns made of synthetic resin fibers such that the warp yarns and the weft yarns are alternately positioned up and down and includes an air layer between the upper and lower cloth bodies are folded back in two at an approximate center in the longitudinal direction of the cloth bodies, and mating end portions of the cloth bodies are assembled and are stitched together to form a tab portion constituted of a gather portion, wherein, at a lower position of the tab portion, a foaming auxiliary portion which is formed by assembling a cloth body having the same quality as a quality of the cloth bodies is arranged.

The present invention according to a second aspect thereof provides a foaming tool for detergent in which cloth bodies having weave textures with a length and a width of 300 mm or less and being formed by plain-weaving warp yarns and weft yarns made of synthetic resin fibers such that the warp yarns and the weft yarns are alternately positioned up and down are folded back in two and overlapped end peripheries are stitched together, another open-end portion is outwardly folded back so as to enclose one open-end portion thus forming an air layer between the upper and lower cloth bodies, and the overlapped end portions of the cloth bodies are assembled and are stitched together to form a tab portion constituted of a gather portion and, further, at a lower position of the tab portion, a foaming auxiliary portion which is formed by assembling a cloth body having the same quality as a quality of the cloth bodies is arranged.

The present invention according to a third aspect thereof is, in the foaming tool of the first and second aspect of the invention, characterized in that a foaming-enhancing cloth body having irregularities on a surface thereof is interposed in the inside of the air layer.

The present invention according to a forth aspect thereof is, in the foaming tool of any one of the first to third aspect of the invention, characterized in that the foaming auxiliary portion is configured such that the cloth body is assembled by winding the cloth body in a vortex shape or by folding the cloth body in a corrugated shape and an end portion of the cloth body is directed downwardly.

The present invention according to a fifth aspect thereof is, in the foaming tool of any one of the first to fourth aspect of the invention, characterized in that the foaming auxiliary portion is formed by assembling a two-layered cloth body which is formed by overlapping the foaming-enhancing cloth body to the cloth bodies.

DETAILED DESCRIPTION OF THE INVENTION

Figure 1:
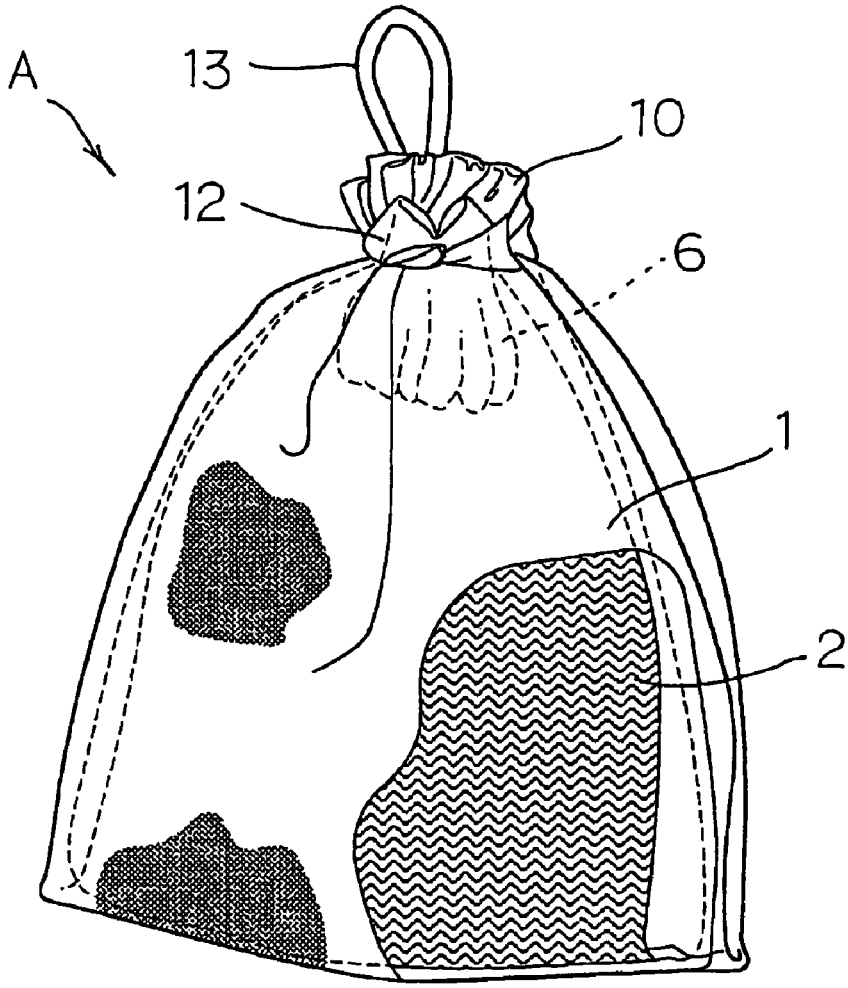
FIG. 1 A front view with a part broken away of a foaming tool according to a first embodiment.

A foaming tool according to the present invention is a foaming tool which is configured such that cloth bodies having weave textures having a length and a width of 300 μm or less and obtained by plain-weaving warp yarns and weft yarns made of synthetic resin fibers such that the warp yarns and the weft yarns are alternately positioned up and down are vertically overlapped to each other and includes an air layer between the upper and lower cloth bodies are folded, and mating end portions are assembled and are stitched to form a tab portion formed of a gather portion, wherein at a lower position of the tab portion, there is provided a foaming auxiliary portion formed by assembling a cloth body which has the same quality as the above-mentioned cloth bodies.

As synthetic fibers which constitute yarns of the cloth body, fibers made of hard-to-stretch polyester can be suitably used, and a size of weave textures of the cloth body is favorably set to 250 μm or less, and more favorably, set to 50 to 100 μm. Here, a lower-limit size of the weave texture is a size which allows detergent to pass therethrough and assures air permeability.

Further, such a cloth body is obtained by plain-weaving warp yarns and weft yarns such that the warp yarns and the weft yarns are alternately positioned up and down and hence, even when the foaming tool is crumpled in use, the deformation of the weave textures is small and foam formed of bubbles having a uniform size can be easily produced.

The foam generated by the foaming tools is used for washing. First of all, the whole foaming tool is suitably moistened and a suitable quantity of detergent such as soap in a solid, liquid or powder form is applied to the foaming tool and, thereafter, the foam is formed while crumpling the foaming tool with hands or the like and, at the same time, a lump of foam is taken out by squeezing the cloth body.

The lump of foam which is taken out contains a large number of ultra-fine bubbles (having a diameter of 5 to 20 μm). By applying the lump of foam to a part to be washed, by wiping off or washing off the foam, the dirt can be easily removed from the part to be washed. Here, when the part to be washed is a skin, the ultra-fine foam enter fine indentations or pores of the skin and dirt components are effectively adsorbed to the foam and hence, a washing effect is remarkably enhanced and, at the same time, it is no more necessary for the user to rub the skin or the like. Accordingly, the foaming tool does not give stimulus to the skin and hence, the foaming tool can be safely used by a user who suffers from a skin disease.

Further, by using the foaming tool, person in hospital or a bed-ridden person, for example, who is difficult to take a bath can effectively wash his/her body. That is, after the foam produced by the foaming tool is applied to a part of body which constitutes the part to be washed, for example, his/her hand, foot, trunk portion or the like, the part to be washed is covered with a steamed towel or the like for a predetermined period and, thereafter, the towel is simply removed whereby a sufficient washing effect can be obtained. Here, although the towel is not limited to the steamed towel, by using the steamed towel, the pores or the like of the skin are opened and hence, the washing effect is further enhanced and, at the same time, a body warming effect can be realized.

In such a foaming tool which can produce such ultra-fine bubbles, the most characterizing constitution of this embodiment lies in that a foaming auxiliary portion which is formed by assembling a cloth body having the same quality as the quality of the above-mentioned cloth body which forms the foaming tool is provided below the tab portion.

By providing the foaming auxiliary portion, the foaming auxiliary portion functions like a pump so as to supply sufficient air into the detergent by taking in or discharging outside air into the detergent thus remarkably enhances the foaming efficiency.

That is, by allowing the foaming tool to contain the detergent and by crumpling the foaming tool by hand, for example, the ultra-fine bubbles are produced. Here, it is considered that, if a large quantity of air can be wrapped in the foaming tool in the crumpling operation, a larger quantity of foam can be produced in a short time. The foaming auxiliary portion according to this embodiment is formed by assembling a cloth body having the same quality as a quality of the foaming tool and hence, the foaming auxiliary portion has an excellent flexibility (resiliency). Accordingly, the foaming auxiliary portion can repeat stretching and contraction and functions just like a pump and hence, a large quantity of air can be efficiently supplied in the detergent.

Further, since the foaming auxiliary portion is arranged below the tab portion, only by holding the tab portion with one hand and by moving the foaming tool in a circle while pushing the foaming auxiliary portion against a palm of another hand by way of the tab portion, it is possible to generate an action substantially equal to a crumpling operation and hence, it is possible to extremely enhance the easy-to-use property of the foaming tool and, at the same time, a large quantity of ultra-fine foam can be produced in a short time. Further, here, the foaming auxiliary portion appropriately stimulates a "sweet spot" of the palm and hence, by using the foaming tool, a massage effect which removes fatigue from a user without making the user recognize the removal of fatigue can be realized.

Further, the foaming auxiliary portion may be formed by assembling the cloth body after winding the cloth body in a spiral or folding the cloth body in a corrugated shape and by directing the end periphery portion of the cloth body downwardly. Due to such a shape, the foaming auxiliary portion acts just like a foaming brush and hence, it is possible to further enhance the foaming effect thus enhancing the production efficiency of the foam.

Here, to produce finer foam, it is desirable to set a volume ratio between the detergent and water 1:2 to 10and, more preferably, to 1:2 to 5.

Further, the foaming tool may interpose a foaming-enhancing cloth having irregularities on a surface thereof in the inside of the air layer which is formed between the cloth bodies arranged vertically in layers.

Such a foaming-enhancing cloth portion is formed of a cloth body woven which has irregularities on one side surface thereof and, favorably, has weave textures of approximately 50 to 100μ. Due to the provision of such a foaming-enhancing cloth body, air is further easily mixed into the foaming tool during the crumpling operation (foaming operation) and hence, it is possible to produce creamier and finer foam which contain a large number of fine bubbles having a diameter of 5 to 20 μm.

As a twisted yarn with which the foaming-enhancing cloth body is woven, rather thick warp yarns each of which is formed by twisting approximately one hundred of ultra-fine single threads and weft yarns finer than the warp yarns can be used. By weaving these warp yarns and weft yarns, a cloth having irregularities on a surface thereof and fine weave textures. By using the foaming-enhancing cloth body having the surface irregularities, it is possible to prevent outer cloth bodies from being brought into close contact with each other when the foaming tool is crumpled so that air retention is favorably maintained. At the same time, by assembling the thick warp yarns and the fine weft yarns, the foaming tool possesses the suitable resiliency and hence, in the same manner as the foaming auxiliary portion, the foaming-enhancing cloth body can take the outside air therein or discharge the outside air just like a pump so as to supply air to a film made of a surfactant which is stretched over the weave texture whereby it is possible to enhance foam producing effect thus effectively producing the finer bubbles.

Further, the film made of the surfactant which is stretched over the weave texture of the foaming-enhancing cloth body per se also becomes foam when the air is taken therein. Here, such foam is retained in the inside of the air layer thus enhancing the foam producing efficiency. That is, the foaming tool which is constituted of the outer cloth body and the inner foaming-enhancing cloth body is suitably moistened and a proper quantity of soap in a solid, liquid, powder form or the like is applied to the foaming tool. When the foaming tool is crumpled, bubbles are produced by soapsuds and air. In the course of intrusion of bubbles into the inside of the foaming tool after passing through the outer cloth body and the foaming cloth body, the bubbles are reproduced into bubbles having a diameter of 50 to 100 μm which corresponds to meshes of respective cloth bodies. Further, such reproduced bubbles occasionally arrive at fine spaces having a size of several microns which are produced innumerably due to a contact between surface irregularities of the outer cloth body and surface irregularities of the inner foaming-enhancing cloth body with each other so that a large number of further finer bubbles having a size of 5 to 20 μm are instantaneously produced.

Further, a group of the produced ultra-fine bubbles is, due to the repetition of the crumpling motion, formed into further ultra-fine bubbles and is stabilized and, thereafter, the group of the bubbles passes through the foaming-enhancing cloth body and the outer cloth body and is carried to the outside of the foaming tool.

Further, the group of bubbles which is carried to the outside of the foaming tool is also guided to the inside of the foaming tool again due to the continuation of the crumpling motion and hence, the production of the bubbles is successively and continuously performed. Here, as described above, the pumping action of the foaming-enhancing cloth body further enhances the efficient foaming.

Further, also by using the foaming-enhancing cloth body in the foaming auxiliary portion, it is possible to form the foaming auxiliary portion in a state that a double-layered cloth body formed by overlapping the foaming-enhancing cloth body to the cloth body is assembled. Due to such a constitution, the foaming efficiency can be further enhanced.

Accordingly, by using the foaming tool which is provided with the forming auxiliary portion having such a constitution, a large number of bubbles can be produced easily in a short time. For example, when the quantity of the foam which is produced by the foaming tool of the present invention and the quantity of foam which is produced by the conventional foaming tool are equal, the bubble producing time necessary for the forming tool of the present invention can be shortened to ½ to ⅓ of the bubble producing time necessary for the conventional foaming tool.

Here, as the foaming-enhancing cloth body, a colored foaming-enhancing cloth body may be suitably used. In this case, the color is viewed through the outer cloth body and hence, the foaming tool can bring about the calm and refined texture.

Further, the foaming tool may have the following constitution.

That is, the foaming tool is constituted such that the cloth bodies having weave textures having a length and a width of 300 μm or less and obtained by plain-weaving warp yarns and weft yarns formed of synthetic resin fibers such that the warp yarns and the weft yarns are alternately positioned up and down are folded, and overlapped end peripheries of the cloth bodies are stitched together and, in a state that one open end portion is wrapped with another open end portion, another open end portion is folded back to the outside and an air layer is formed between the cloth bodies and, at the same time, the overlapped portions of two open end portions are assembled and are stitched to form a tab portion formed of a gather portion and, further, at a lower position of the tab portion, a foaming auxiliary portion formed by assembling a cloth body which has the same quality as the quality of the above-mentioned cloth bodies is provided.

Due to such a constitution, in the same manner as the above-mentioned foaming tool, it is possible to efficiently produce extremely fine, creamy, easy-to-stretch and hard-to-disappear foam in an extremely short time and, at the same time, the part to be washed can be washed by using the produced ultra-fine bubbles in a state that the foaming auxiliary portion is directly brought into contact with the part to be washed and hence, the part to be washed can be effectively washed. Further, also in this case, it is preferable that the foaming-enhancing cloth body is arranged in the air layer.

In the foaming tool which has been described above, it is possible to efficiently produce ultra-fine foam further easily and, using the ultra-fine foam, smart and effective washing can be performed without performing an operation such as scrubbing. Further, the foaming tool is suitably used for face washing and, at the same time, exhibits the sufficient aesthetic appearance in design and hence, particularly, the foaming tool is particularly possessed by a woman or the like.

Here, as the part to be washed using the foam produced by the foaming tool, in addition to the face, the hand and the foot or the trunk, hair may be named. Further, in addition to the parts of human body, various articles including fibers, wall paper, ceramics such as tiles and tableware, a glass product, a metal surface or a painted surface of a car body or the like, a wooden surface of a furniture or the like, and leathers may be named as the object to be washed. That is, provided that the article has small irregularities on a surface thereof, dirt components adhered to the inside of the irregularities is adsorbed by fine foam thus obtaining the effective washing effect.

Further, the kind of soap is also not limited and, the soap may be suitably selected and used depending on a usage thereof.

EMBODIMENTS

Hereinafter, embodiments of a foaming tool according to the present invention are specifically explained in conjunction with drawings.

First Embodiment

Figure 2:
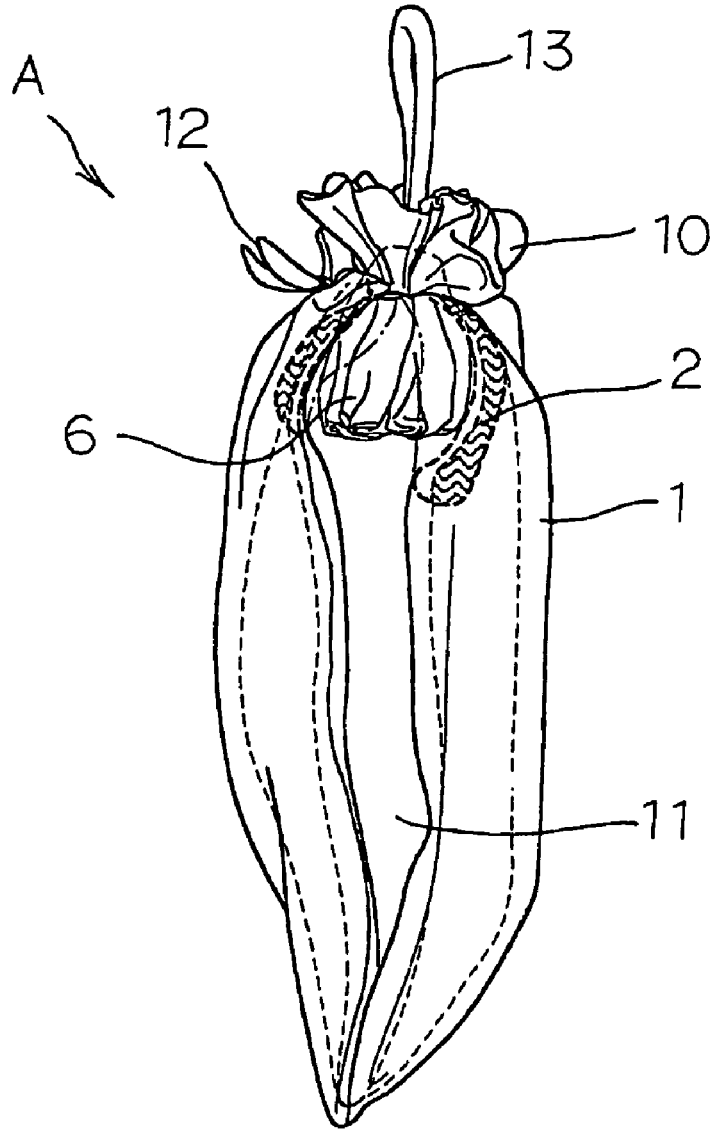
FIG. 2 An explanatory view of the foaming tool as viewed in a side view.
Figure 3:
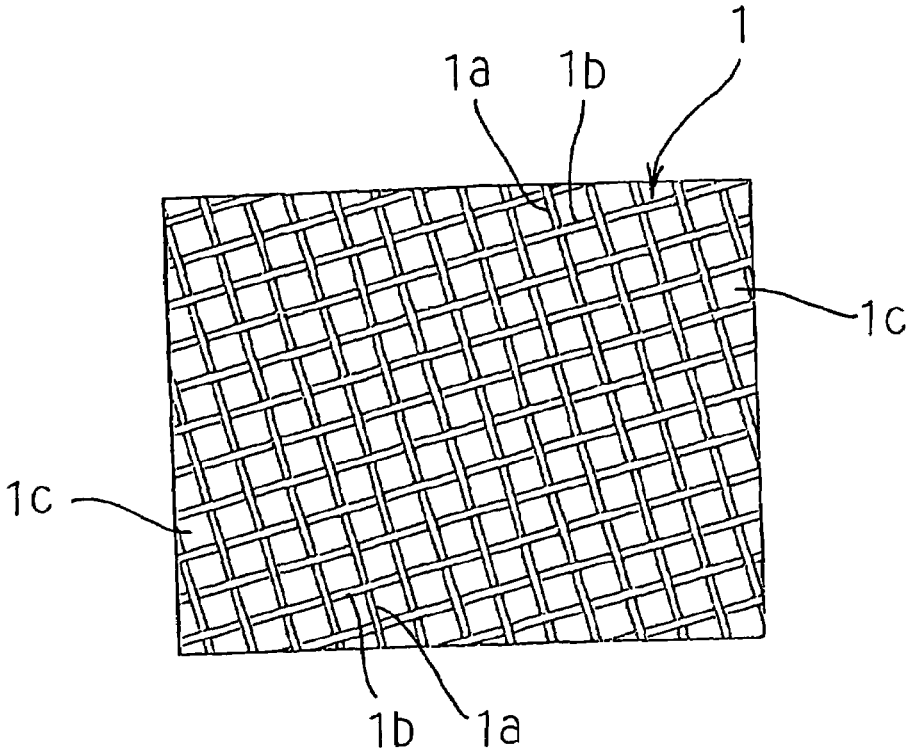
FIG. 3 An explanatory view showing weave textures of an outer cloth body which constitutes the foaming tool.
Figure 4:
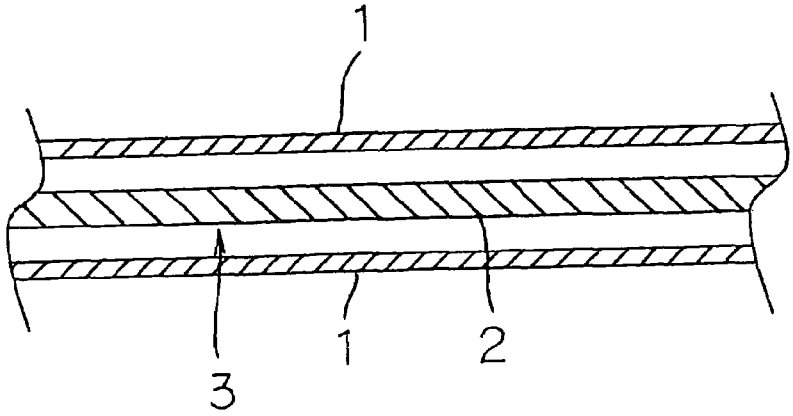
FIG. 4 An enlarged explanatory view of the outer cloth body as viewed in a cross-sectional view.
Figure 5:
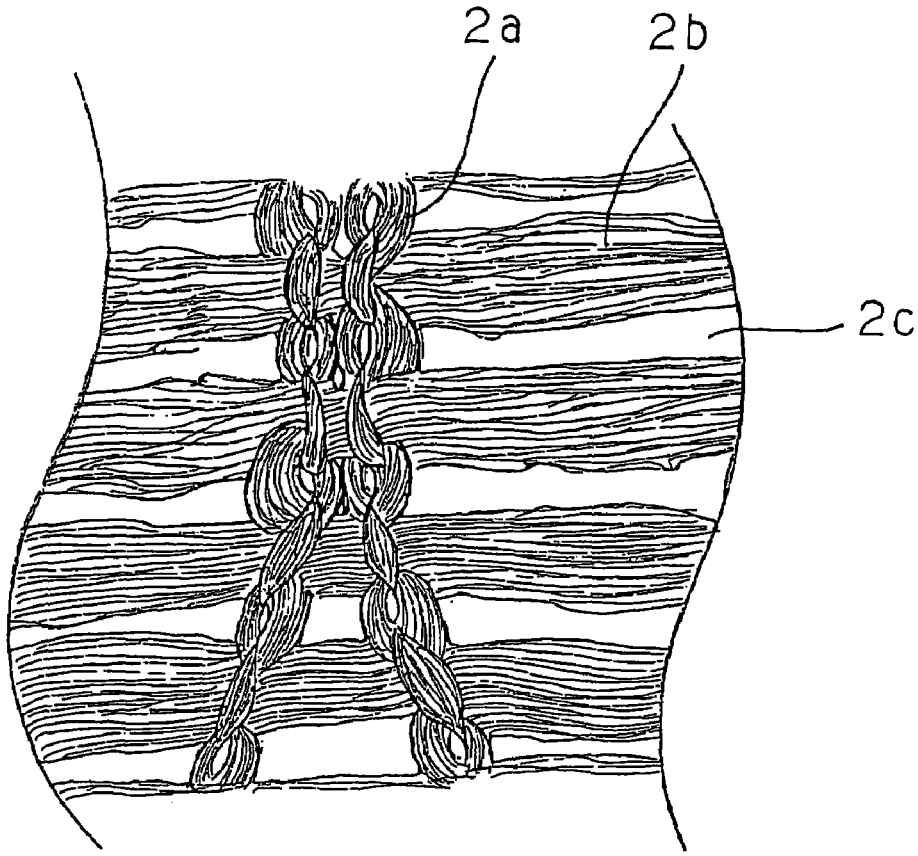
FIG. 5 An explanatory view showing weave textures of an inner cloth body.
Figure 6:
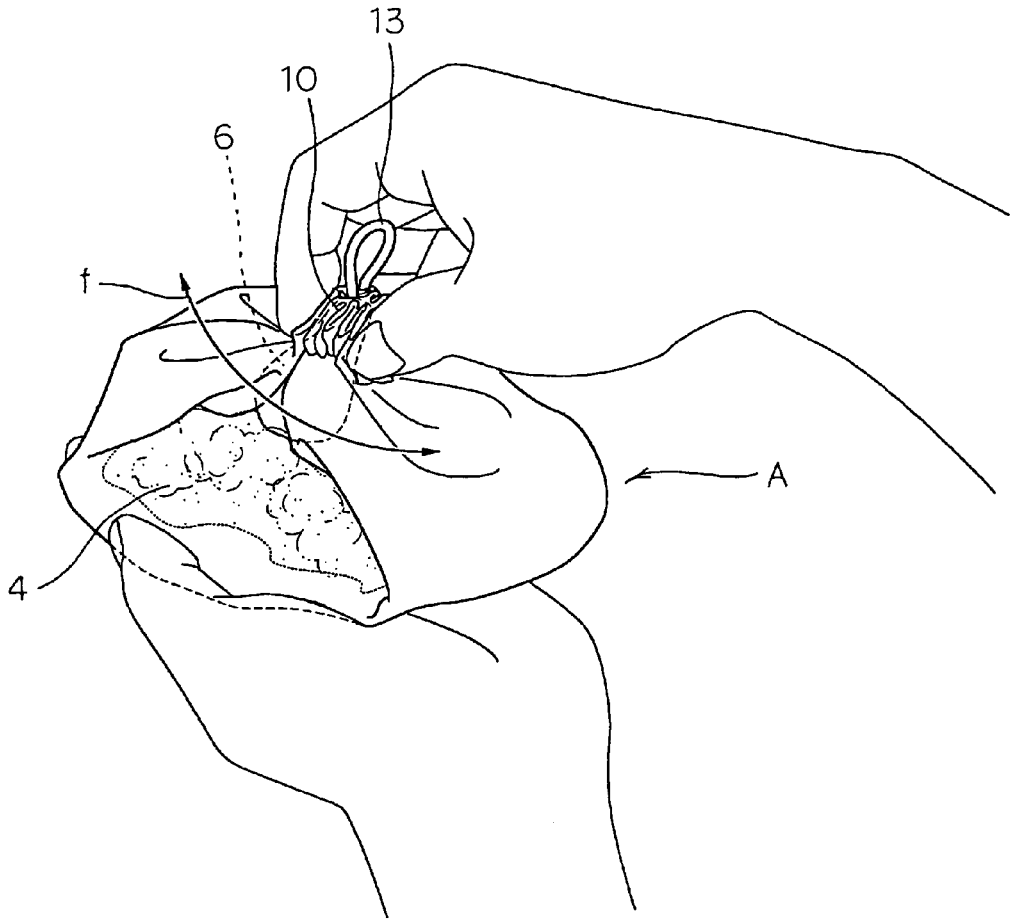
FIG. 6 An explanatory view showing using condition of the foaming tool.
Figure 7:
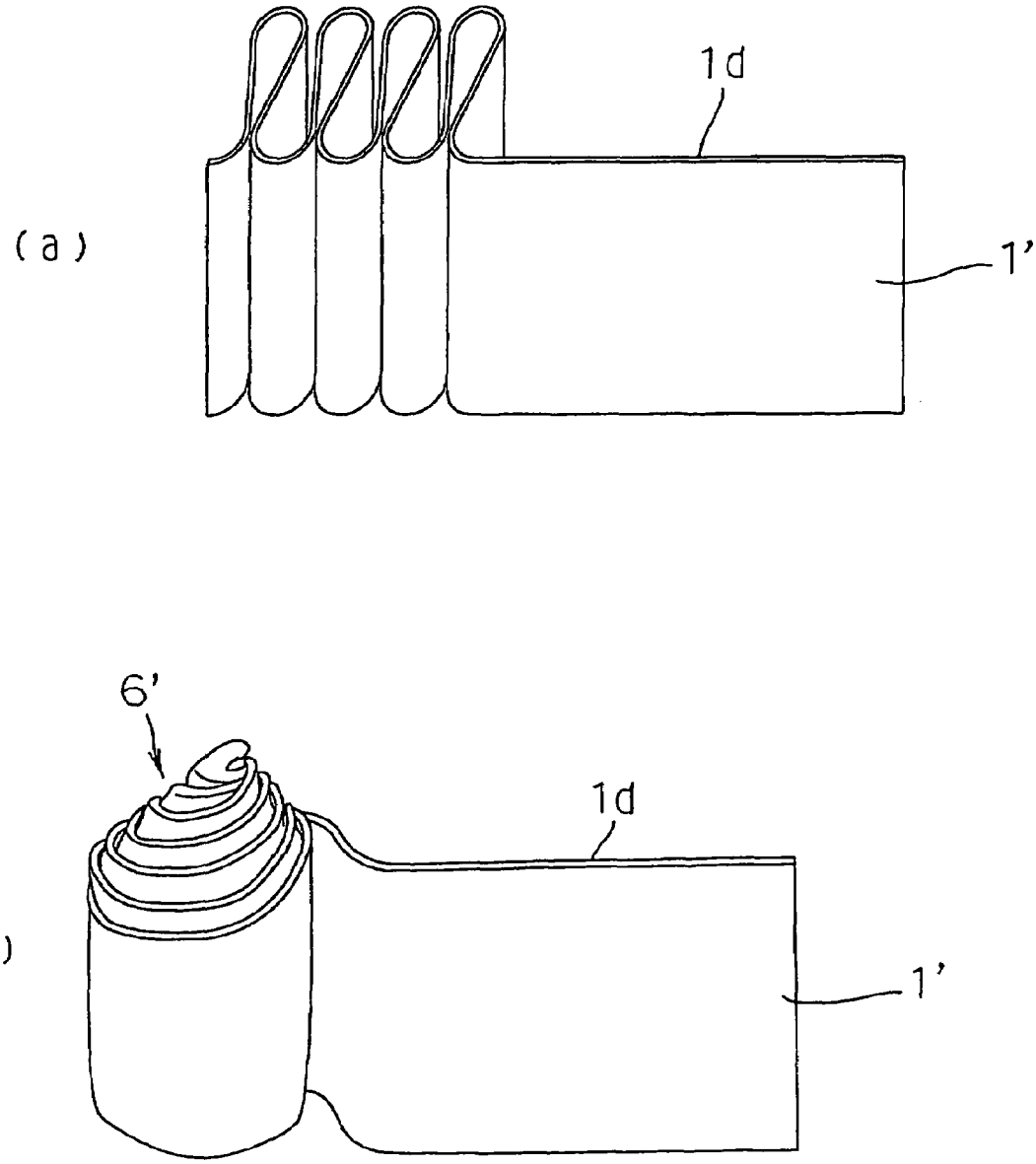
FIG. 7 An explanatory view showing a manufacturing method of a foaming auxiliary portion.
Figure 8:
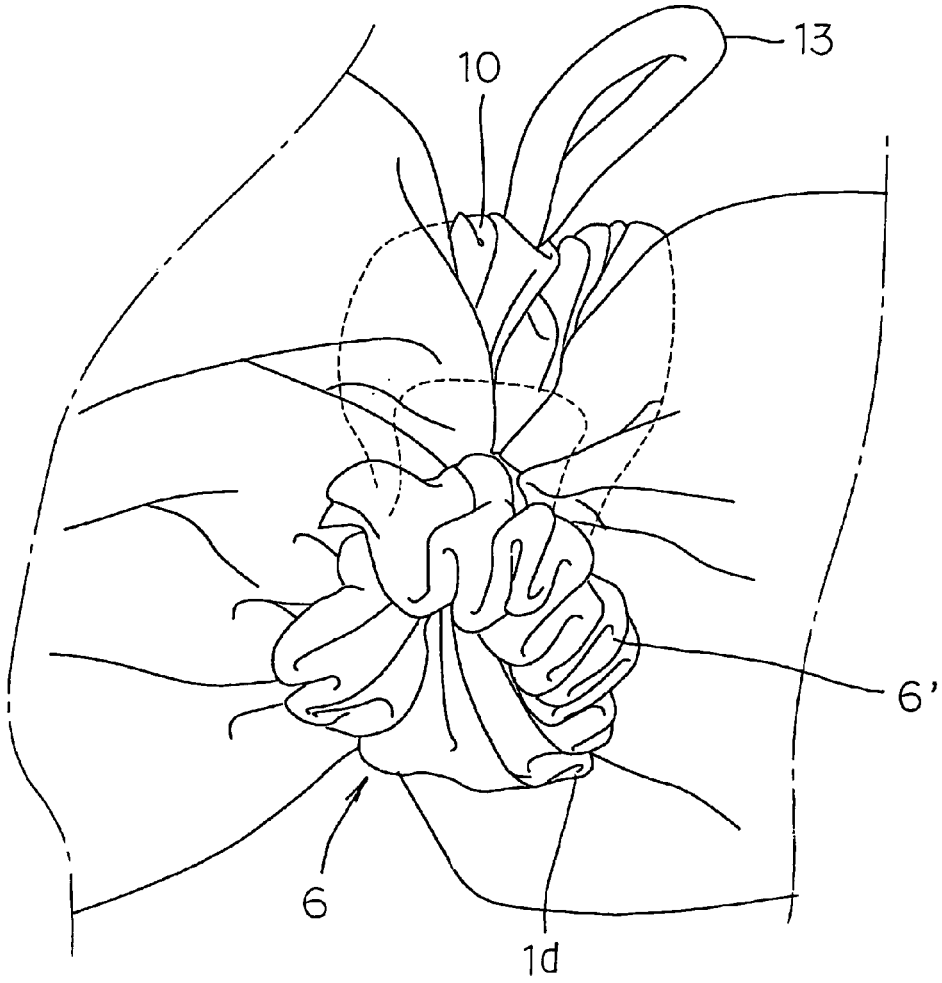
FIG. 8 An explanatory view showing a form of the foaming auxiliary portion.
Figure 8:
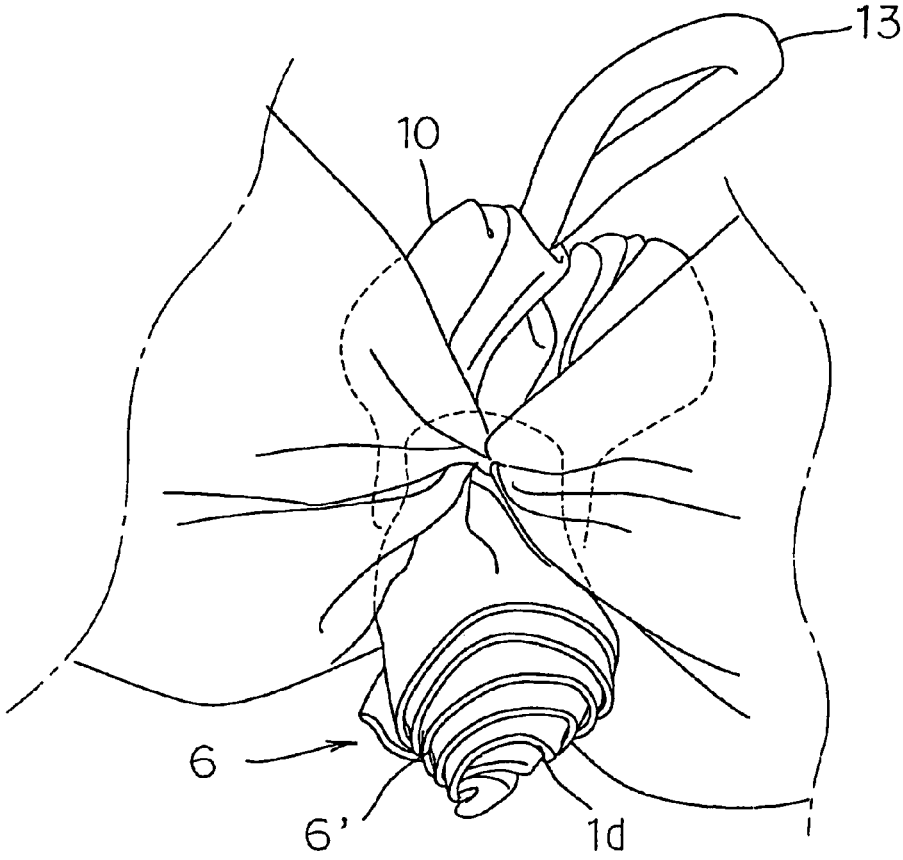
Figure 9:
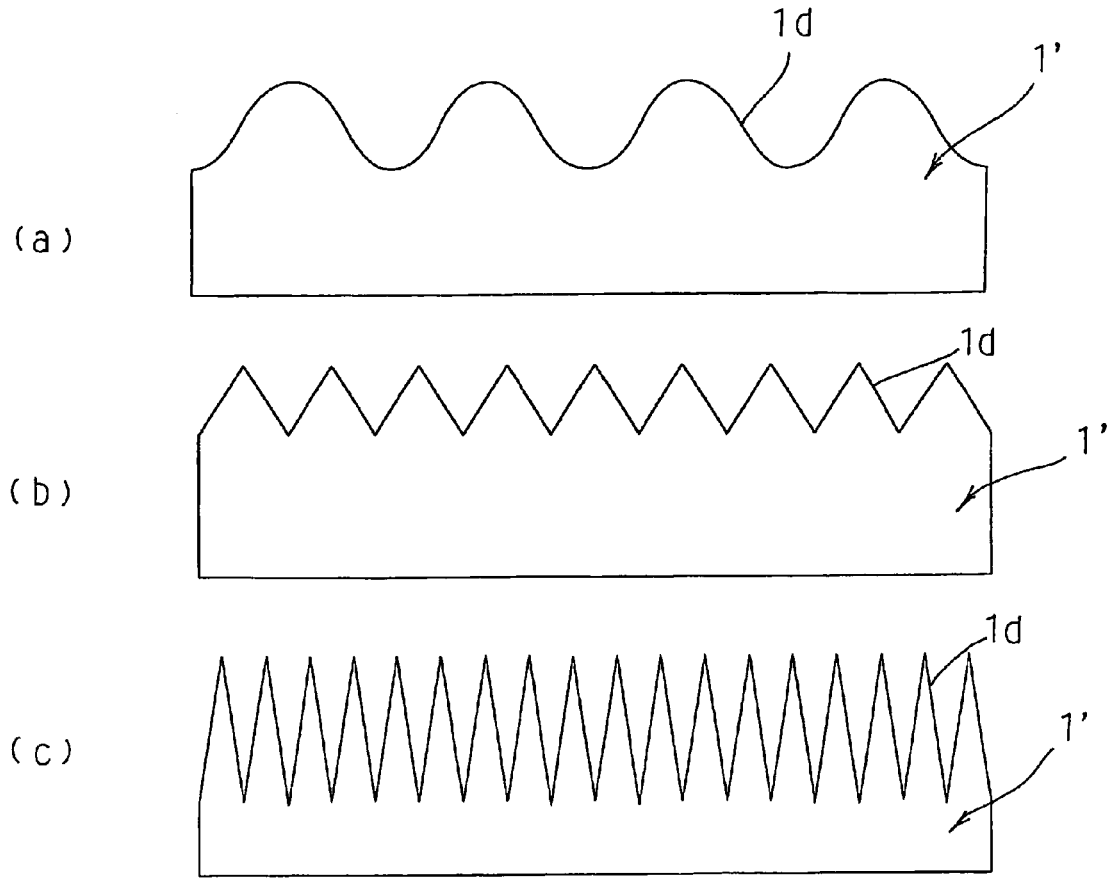
FIG. 9 An explanatory view of a shape of a cloth body which constitutes the foaming auxiliary portion.
Figure 10:
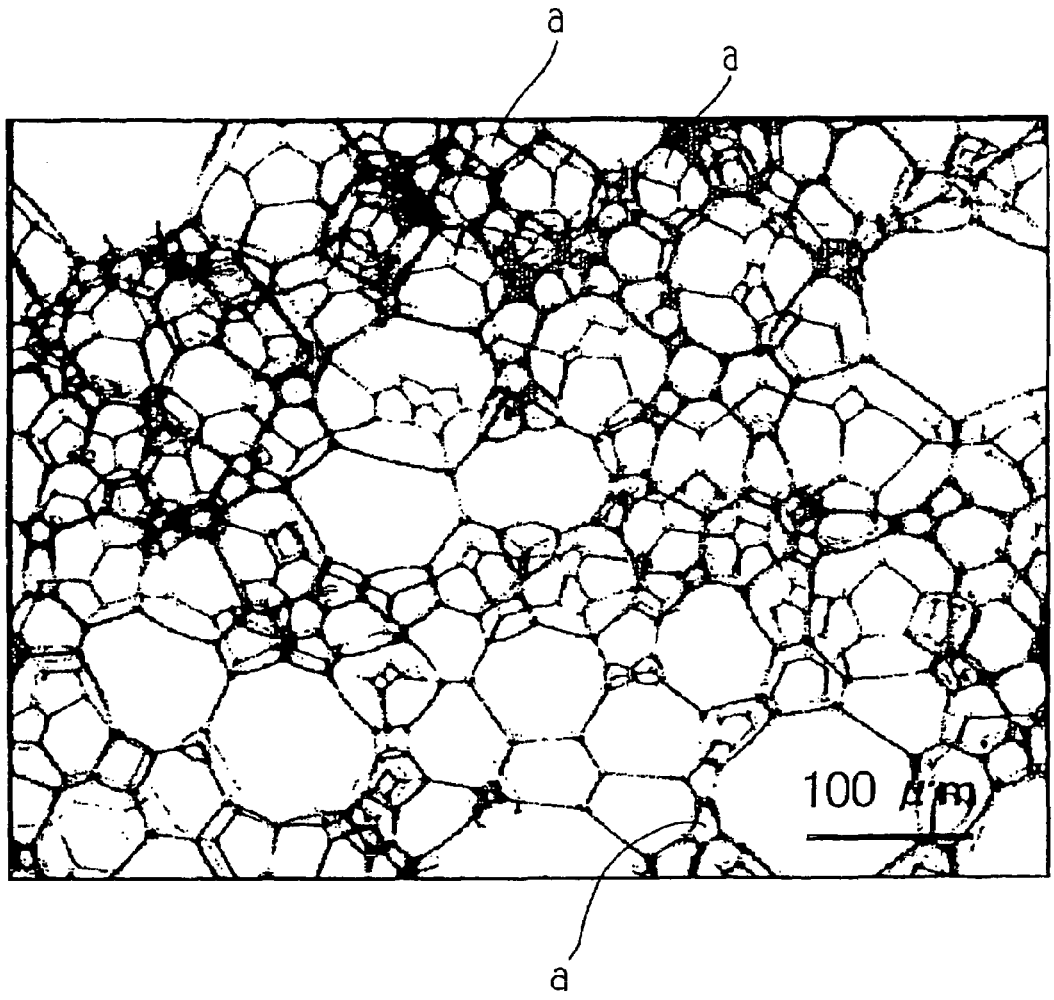
FIG. 10 An enlarged view of bubbles which are produced by the foaming tool of the present invention.

FIG. 1 is a front view with a part broken away of a foaming tool according to a first embodiment, FIG. 2 is an explanatory view of the foaming tool as viewed in a side view, FIG. 3 is an explanatory view showing weave textures of an outer cloth body which constitutes the foaming tool, FIG. 4 is an enlarged explanatory view of the outer cloth body as viewed in a cross-sectional view, FIG. 5 is an explanatory view showing weave textures of an inner cloth body, FIG. 6 is an explanatory view showing a using condition of the foaming tool, FIG. 7 is an explanatory view showing a manufacturing method of a foaming auxiliary portion, FIG. 8 is an explanatory view showing a form of the foaming auxiliary portion, FIG. 9 is an explanatory view of a shape of a cloth body which constitutes the foaming auxiliary portion and FIG. 10 is an enlarged view of bubbles which are produced by the foaming tool of the present invention.

As shown in FIG. 1 and FIG. 2, the foaming tool A is constituted of an outer cloth body 1 which is woven using synthetic resin fibers substantially formed of polyester and stitched into a cylindrical shape and an inner cloth body 2 which is arranged in the inside of the outer cloth body 1 as a foaming-enhancing cloth body.

The outer cloth body 1 has a double-layer structure in which cloth bodies are folded in two, overlapped end peripheries thereof are stitched to each other to form a cylindrical shape, and the cloth bodies are made flat in a state that the cloth bodies are vertically overlapped to each other and, further, the cloth bodies are folded at an approximately center thereof in the longitudinal direction and the mating end portions are assembled and are stitched to each other to form a tab portion 10 formed of a gather portion at an end portion thereof. Numeral 12 indicates an ornamental body such as a ribbon which is mounted on one side surface of a squeezed portion of the tab portion 10 and numeral 13 indicates a hanger ring which is also used for inserting a finger.

Further, the outer cloth body 1 has, as shown in FIG. 3, weave textures each of which has a length and a width of 300 μm or less. It is more preferable that the outer cloth body 1 is woven in plain weaving with weave textures each of which has a length and a width within a range from 50 to 100 μm, and the warp yarns 1*a* and the weft yarns 1*b* are alternately positioned up and down. Here, the size of the weaving texture 1*c* in this embodiment is set to 80 μm. Accordingly, the hand feeling of the outer cloth body 1 is extremely soft. Here, as shown in FIG. 4, the inner cloth body 2 is interposed in the inside of an air layer 3 which is formed between the outer cloth bodies 1, 1 which have double-layer structure.

The inner cloth body 2 is a fabric formed of twisted yarns made of polyester fibers in the same manner as the outer cloth body 1 and is woven in a state that the inner cloth body 2 has irregularities on one side surface thereof. Here, as shown in FIG. 5, the inner cloth body 2 also has weave textures 2*c* each of which has a size of approximately 50 to 100μ. Further, as twisted yarns for weaving the inner cloth body 2, as shown in FIG. 5, rather thick warp yarns 2*a* which are made by twisting an approximately one hundred of ultra-fine single threads and weft yarns 2*b* finer than the warp yarns can be used. The warp yarns 2*a* are woven in chain and, wherein by weaving the warp yarns 2*a* and the weft yarns 2*b* together, irregularities are formed on one side surface of the inner cloth body 2 and, the ultra-fine weave texture 2*c* is formed.

Further, the inner cloth body 2 may suitably have a desired tone of the color and, by allowing the color of the inner cloth body 2 to be faintly seen through the outer cloth body 2, the foaming tool can bring about a refined and smart appearance.

In addition to the above-mentioned basic constitution, this embodiment is characterized in that a foaming auxiliary portion 6 which is formed by assembling a cloth body 1' having the same quality as a quality of the outer cloth body 1 is mounted on a lower portion of the tab portion 10.

In the foaming auxiliary portion 6, an end peripheral portion of the assembled cloth body 1' is directed downwardly and, as shown in FIG. 7(1), the foaming auxiliary portion 6 is formed by folding the cloth body 1' in a corrugated shape and assembling the cloth body 1' or, as shown in FIG. 7(*b*), by winding the cloth body 1' in a vortex shape. In any case, in the foaming tool A, the foaming auxiliary portion 6 acts just like a foaming brush and hence, the foaming effect is further enhanced thus increasing the foam producing efficiency.

Shapes of the foaming auxiliary portion 6 are shown in FIG. 8(*a*) and FIG. 8(*b*), wherein the foaming auxiliary portion 6 shown in FIG. 8(*a*) has a shape formed by assembling the cloth body 1' in a corrugated shape as shown in FIG. 7(*a*). On the other hand, the foaming auxiliary portion 6 shown in FIG. 8(*b*) is formed by winding the cloth body 1' in a vortex shape as shown in FIG. 7(*b*), and a vortex portion 6' appears like a rose and hence, the foaming auxiliary portion 6 exhibits the beautiful appearance at and enhances the aesthetic appearance also in design.

Here, to allow such a foaming auxiliary portion 6 to act like the foaming brush as described above, it is unnecessary to cut an end periphery 1*d* of the cloth body 1' straightly, and as shown in FIG. 9, the cut end periphery 1*d* may have a wave form (FIG. 9(*a*)) or a saw-shaped form (FIG. 9(*b*), (*c*)). In this manner, by the foaming auxiliary portion 6 by directing the non-straight cut end periphery 1*d* downwardly (see FIG. 8), the action of the foaming auxiliary portion as the foaming brush is further enhanced.

A case in which foam is produced by actually using the foaming tool A provided with such a foaming auxiliary portion 6 is explained in conjunction with FIG. 6. Here, the case in which the foaming is performed using solid soap as detergent is explained.

First of all, the foaming tool A is immersed in water or warm water and, thereafter, the foaming tool A is sufficiently squeezed and hence, the foaming tool A assumes a suitably moistened state. Here, the solid soap is accommodated in the inside of a soap accommodating space 11 (see FIG. 2) which is formed by folding the foaming tool A in two by stitching together at the gather portion having the air layer 3, the foaming tool A is crumpled such that soap components are spread all over the outer cloth body 1 and the inner cloth body 2 and, thereafter, as shown in FIG. 6, the tab portion 10 is picked by one hand and, at the same time, a bottom portion of the foaming tool A is supported by another hand, and the foaming auxiliary portion 6 is rubbed against the outer cloth body 1 and the inner cloth body 2 in the bottom portion of the foaming tool A in a circular motion as shown by an arrow f while the picked portion 10 is pushed against the bottom portion of the foaming tool A. Here, the foaming auxiliary portion 6 acts like the foaming brush, and a large number of bubbles is produced using soapsuds and air. Further, when the bubbles pass through the outer cloth body 1 and the inner cloth body 2 and advance to the inside of the foaming tool A, the bubbles are reproduced into bubbles having a diameter of 50 to 100 μm which correspond to the respective weave textures 1*c*, 2*c* of the outer cloth body 1 and the inner cloth body 2. Further, such reproduced bubbles occasionally arrive at fine spaces having a size of several microns which are formed innumerably due to a contact between surface irregularities of the outer cloth body 1 and irregularities of the inner foaming-enhancing cloth body 2 with each other so that a large number of bubble groups 4 formed of further ultra-fine bubbles having a size of 5 to 20 μm are instantaneously produced.

Further, the produced bubble groups 4 of the ultra-fine bubbles are, by repeating the rubbing motion which is substantially equal to the crumpling motion, formed into further ultra-fine bubbles and stabilized, and the bubble groups 4 pass through the outer cloth body 1 and the inner cloth body 2 and are carried to the outside of the foaming tool A.

Further, the foaming tool A is provided with the inner cloth body 2 having surface irregularities in the inside of the air layer 3 formed between the outer cloth body 1 and the inner cloth body 2 and hence, by preventing the outer cloth bodies 1, 1 which assume double layers while preventing foam from being brought into close contact with each other, an air retention is favorably maintained and, further, the inner cloth body 2 has an adequate resiliency by assembling the thick warp yarns 2*a* and the fine weft yarns 2*b* and hence, the foaming tool A can take in and discharge the outside air like a pump so that the air is supplied to a film of surfactant which is stretched over the weave texture 2*c* and hence, it is possible to enhance the foam producing effect and the finer bubbles can be effectively produced. Further, the film of soapsuds stretched over the weave textures 2*a* of the inner cloth body 2 per se also becomes foam when the air is taken into the film and also, such foam is held in the inside of the air layer thus enhancing the foam producing efficiency.

Still further, according to this embodiment, the foaming auxiliary portion 6 functions as the foaming brush and, at the same time, since the foaming auxiliary portion 6 per se has flexibility, the foaming auxiliary portion 6 repeats stretching and contraction and functions like a pump and hence, a further foaming effect can be obtained thus realizing efficient production of foam which has not been achieved by the conventional foaming tool. Further, here, the foaming auxiliary portion 6 appropriately stimulates a "sweet spot" of the palm and hence, by using the foaming tool A, a massage effect is obtained and, by continuously using the foaming tool A, an effect which removes fatigue from a user without making the user recognize removal of fatigue can be realized.

In this manner, by using the foaming tool A, the bubble groups 4 formed of a large number of bubbles can be produced easily in a short time. As a result of experiments, it is understood that the foaming tool A exhibits foam producing efficiency which is as approximately twice or three times large as the foam producing efficiency of the conventional forming tool (for example, a foaming tool disclosed in J-P-A 2004-000303).

FIG. 10 shows an enlarged view of the foam produced using the foaming tools A according to this embodiment and, it is understood that a large number of ultra-fine bubbles having a diameter of 8 μm to 10 μm are produced. This is a level of size of bubbles which can not be produced using the conventional foaming tool.

The bubble groups 4 which contain large number of ultra-fine bubbles produced in this manner can be easily put on a palm as a lump of foam by squeezing the whole foaming tool A, and the lump of foam which has been taken out is applied to a part to be washed and, thereafter, the foam is wiped off or washed off whereby a large washing effect can be obtained. Further, as described above, while using the foaming tool A, the massage effect is obtained and hence, the user's physical condition can be regulated.

Further, the lump of foam contains small quantity of water and hence, the molecular structure of surfactants securely forms an external skeleton of the foam whereby the lump of foam is hard to disappear and is easy to stretch. Accordingly, it is possible to maintain an effect in which the foam adsorbs the dirt components can be maintained for a long time and, further, after the foam is wiped off, the user does not feel an uncomfortable slimy feeling.

I by using the foaming tool A while making use of such properties, for example, a person in hospital or a bed-ridden person who has difficulty in taking a bath can wash his/her body in place of taking a bath.

Second Embodiment

Figure 11:
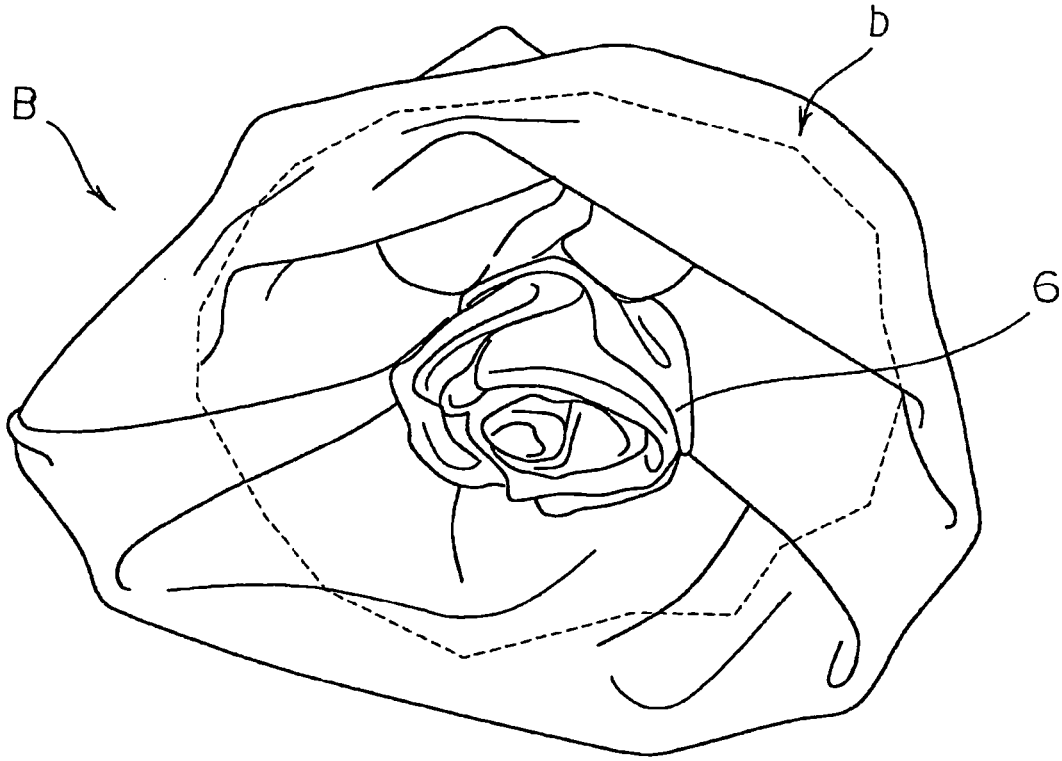
FIG. 11 An explanatory view of foaming tool according to a second embodiment.
Figure 12:
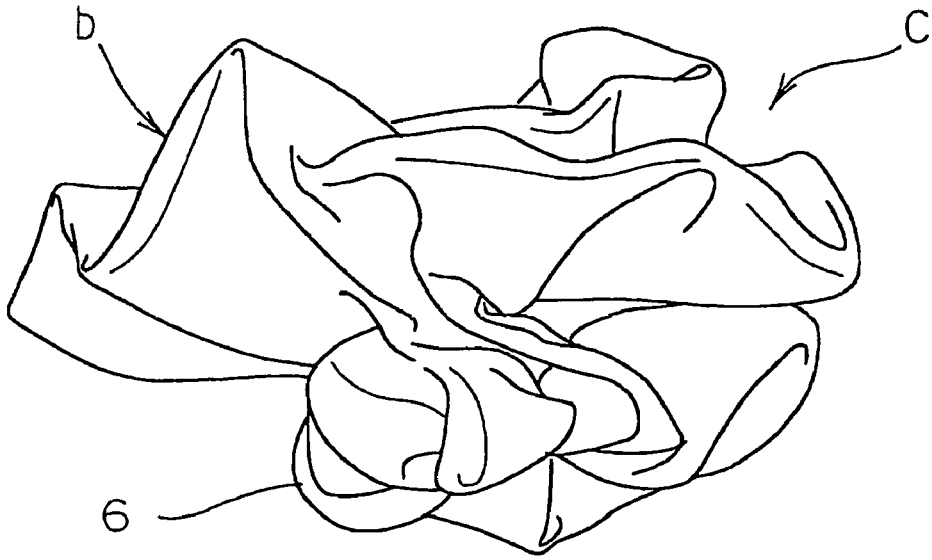
FIG. 12 An explanatory view showing a modification of the foaming tool.

Next, the foaming tool B according to a second embodiment is explained in conjunction with FIG. 11 and FIG. 12. Here, constitutional elements identical with the constitutional elements shown in the previous first embodiment are given the same symbols and the explanation thereof is omitted.

The foaming tool B shown in FIG. 11 is a foaming tool which is formed such that the outer cloth body 1 which is explained in the embodiment 1 and is obtained by plain-weaving is folded in two and overlapped end peripheries 16, 16 are stitched together in a state that one open end portion 14 is wrapped with another open end portion 15, another open end portion 15 is folded back to the outside, and an air layer 3 is formed between the cloth bodies 1 and, at the same time, the overlapped portions of two open end portions 14, 15 are assembled and are stitched together to form a tab portion 10 formed of a gather portion and, further, at a lower position of the tab portion 10, there is provided a foaming auxiliary portion 6 formed by assembling a cloth body which has the same quality as the quality of the above-mentioned cloth body 1. Further, the inner cloth body 2 which is explained in the embodiment 1 is also arranged in the inside of the air layer 3.

That is, the foaming tool B according to this embodiment differs from the embodiment 1 in that whole shape of the foaming tool body b which is constituted of the outer cloth body 1 and the inner cloth body 2 is slightly made flattened and wide compared to the first embodiment.

Figure 13:
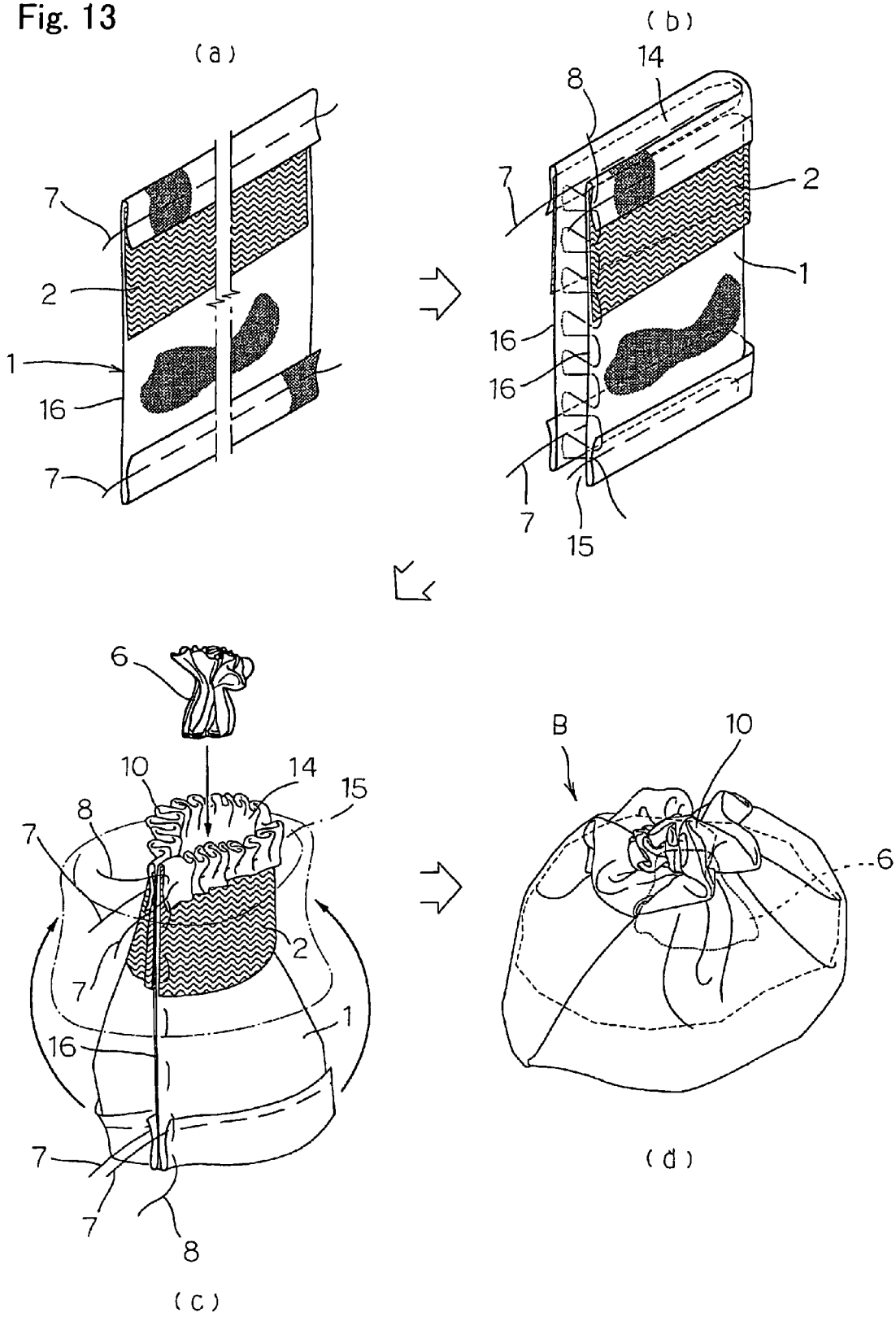
FIG. 13 An explanatory view showing a manufacturing method of the foaming tool according to the second embodiment.

In the foaming tool B according to this embodiment, first of all, the outer cloth body 1 which is cut into a rectangular shape having a predetermined size, the inner cloth body 2 which has a size approximately half of the outer cloth body 1, and a foaming auxiliary portion 6 which is preliminarily formed are prepared. Then, as shown in FIG. 13(*a*), first of all, the inner cloth body 2 is mounted on one side surface of the outer cloth body 1 by stitching. Here, the end portion is folded back and, at the same time, a thread 7 may be favorably put into the end portion so that the thread 7 can be tightened afterwards.

Next, as shown in FIG. 13(*b*), the body is folded in a state that the surface on which the inner cloth body 2 is attached is directed to the outside, and the overlapped end peripheries 16, 16 are stitched by a thread 8.

Here, as shown in FIG. 13(*c*), in a state that one open end portion 14 is wrapped with another open end portion 15, the another open end portion 15 is folded back to the outside and the air layer 3 is formed between the cloth bodies 1 and, at the same time, the overlapped portions of two open end portions 14, 15 are assembled and are stitched together using the thread 7 to form the tab portion 10 formed of the gather portion. Here, by inserting the foaming auxiliary portion 6 which is prepared separately into the cloth body from the open end portions 14, 15, the lower position of the tab portion 10 and the foaming auxiliary portion 6 is fixed by stitching together with the gather portion.

Through such steps, as shown in FIG. 13(*d*), the foaming tool B (see FIG. 11) which has the foaming auxiliary portion 6 arranged below the tab portion 10 and has the appearance different from the appearance of the foaming tool A can be obtained.

Foam which is produced using the foaming tool B having such a shape is similar to the foam produced using the foaming tool A according to the first embodiment. Further, since the foaming tool B can expose the foaming auxiliary portion 6, the foaming auxiliary portion 6 can be directly pushed against a part to be washed for washing the part to be washed with foam. The foaming auxiliary portion 6 is, as described above, formed of a cloth body 1' which has the same quality as a quality of the outer cloth body 1 and hence, the foaming auxiliary portion 6 is flexible. For example, in washing an article having a fragile surface such as a lacquered ware is performed, it is possible to beautifully wash the article without damaging the surface. Further, since the foaming tool body b is flattened and made wide, it is possible to efficiently wash the part to be washed by pushing the foam against the part to be washed widely.

Further, a foaming tool C shown in FIG. 12 is a modification of this embodiment in which a size ratio of the foaming auxiliary portion 6 with respect to the foaming tool body b is increased. Here, the foaming tool body b is made smaller than the foaming tool b shown in FIG. 11 to make the foaming tool B compact thus particularly allowing only the foaming auxiliary portion 6 to perform the washing action with respect to the part to be washed.

Such a foaming tool C can be favorably used as a foaming tool specialized for washing a heel, for example. That is, as explained in the previous first embodiment, foam which is produced using the foaming tool C contains a large number of ultra-fine bubbles which can enter the skin and, due to the washing with such foam, a keratinized part of the heel is removed and hence, even the heel can have the smooth and beautiful skin.

The present invention is explained in conjunction with respective embodiments heretofore. However, only specific examples are exemplified here and the present invention is not particularly limited to these constitutions. That is, the present invention is characterized in that the foaming tool for detergent which are formed such that the cloth bodies having weave textures having the length and the width of 300 μm or less and obtained by plain-weaving warp yarns and weft yarns made of synthetic resin fibers such that the warp yarns and the weft yarns are alternately positioned up and down are vertically overlapped to each other and includes an air layer between the upper and lower cloth bodies are folded at the approximate center in the longitudinal direction of the cloth bodies, and the mating end portions of the cloth bodies are assembled and are stitched together to form the tab portion formed of the gather portion, wherein, at the lower position of the above-mentioned tab portion, there is provided the foaming auxiliary portion formed by assembling the cloth body which has the same quality as the quality of the above-mentioned cloth bodies, and the size of whole body and the shape and the size of the foaming auxiliary portion may be suitably set.

Further, the advantageous effects described in the modes for carrying out the present invention or the embodiments of the present invention are enumerated only as the most favorable advantageous effects obtained by the present invention and, the advantageous effects according to the present invention is not limited to the advantageous effects described in the mode for carrying out the present invention or the embodiments of the invention.

INDUSTRIAL APPLICABILITY

The present invention is useful as a foaming tool which produces foam for various washing including body washing and can produce ultra-fine, creamy, easy-to-stretch and hard-to-disappear foam in an extremely short time. Further, the foaming tool has a sufficient aesthetic appearance in design and hence, the foaming tool is most favorably possessed particularly by a woman or the like and, further, while producing foam, the foaming auxiliary portion comfortably stimulates the palm so that even appropriate massage effect is obtained and hence, it is possible to enhance the commercial value of the foaming tool which is used almost everyday.

Further, the produced foam is applied to the part to be washed and, after a suitable time, the foam are wiped off or rinsed off whereby the effective surface washing can be performed. Particularly, the foam is not necessary to be rinsed off with water and hence, the wash place is not limited. Further, when the foaming tool according to the present invention is used for face washing, the foam which is extremely fine, creamy, easy-to-stretch, hard-to-disappear enter the pores of the skin and adsorb dirt and hence, it is possible to keep the skin clean.

The invention claimed is:

1. A foaming tool for detergent comprising a two-layered cloth body comprising vertically overlapping cloth bodies having weave textures with a length and a width of 300 mm or less and being formed from plain-weaving warp yarns and weft yarns made of synthetic resin fibers such that the warp yarns and the weft yarns are alternately positioned up and down and includes an air layer between outer and inner cloth bodies which are folded back in two at an approximate center in the longitudinal direction of the cloth bodies, and mating end portions of the cloth bodies are assembled and are stitched together to form a tab portion constituted of a gather portion, wherein, at a lower position of the tab portion and in between inner cloth bodies, a separate foaming auxiliary portion is arranged, said foaming portion being formed by assembling a separate cloth body.

2. A foaming tool for detergent comprising a cloth body having weave textures with a length and a width of 300 mm or less and being formed from plain-weaving warp yarns and weft yarns made of synthetic resin fibers such that the warp yarns and the weft yarns are alternately positioned up and down which is folded back in two and overlapped end peripheries are stitched together, another open-end portion is outwardly folded back in two so as to enclose one open-end portion thus forming an air layer between outer and inner cloth bodies, and the overlapped end portions of the cloth bodies are assembled and are stitched together to form a tab portion constituted of a gather portion and, further, at a lower position of the tab portion and in between inner cloth bodies, a separate foaming auxiliary portion is arranged, said foaming portion being formed by assembling a separate cloth body.

3. A foaming tool according to claim 1 or claim 2, wherein a foaming-enhancing cloth body having irregularities on a surface thereof is interposed in the inside of the air layer.

4. A foaming tool according to claim 1 or claim 2, wherein the foaming auxiliary portion is configured such that the cloth body is assembled by winding the cloth body in a vortex shape or by folding the cloth body in a corrugated shape and an end portion of the cloth body is directed downwardly.

5. A foaming tool according to claim 1 or claim 2, wherein the foaming auxiliary portion is formed by arranging a two-layered cloth body which is formed by overlapping a foaming-enhancing cloth having surface irregularities to the cloth body.

* * * * *